US007556125B1

(12) United States Patent
Blehm

(10) Patent No.: US 7,556,125 B1
(45) Date of Patent: Jul. 7, 2009

(54) LADDER RIDGE ANCHOR AND ATTACHMENT AND STABILIZER SYSTEM

(76) Inventor: Berle G. Blehm, 3120 Foothill Blvd., Oroville, CA (US) 95966

( * ) Notice: Subject to any disclaimer, the term of this patent is extended or adjusted under 35 U.S.C. 154(b) by 0 days.

(21) Appl. No.: 11/691,694

(22) Filed: Mar. 27, 2007

Related U.S. Application Data

(60) Provisional application No. 60/820,649, filed on Jul. 28, 2006.

(51) Int. Cl.
*E06C 7/00* (2006.01)

(52) U.S. Cl. ..... 182/214; 182/107; 182/45

(58) Field of Classification Search ..... 185/107, 185/214, 45, 121, 122
See application file for complete search history.

(56) References Cited

U.S. PATENT DOCUMENTS 2,177,677 A * 10/1939 Staben ..... 182/21
2,327,317 A * 8/1943 Randall ..... 182/214
3,459,277 A * 8/1969 Frederick ..... 182/214
3,606,226 A 9/1971 Bell
4,379,498 A * 4/1983 Krusmark ..... 182/107
4,678,061 A 7/1987 Jordan
5,261,507 A * 11/1993 Williams et al. ..... 182/214
6,913,114 B1 * 7/2005 Blehm ..... 182/214
2005/0139425 A1 * 6/2005 Thomas et al. ..... 182/214

* cited by examiner

*Primary Examiner*—Alvin C Chin-Shue
(74) *Attorney, Agent, or Firm*—William Bodnar

(57) ABSTRACT

A ladder ridge anchor device and system incorporating new and improved mechanisms are disclosed herein for attaching a ladder to a roof ridge anchor to secure a ladder over the roof ridge of a building. These improvements also allow the user to easily adjust the position of the ladder relative to the roof ridge anchor to facilitate work on and access to the roof or other building areas. Stabilizing components help prevent lateral movement of the ladder with respect to the attached ridge anchor and extension components elevate the ladder and roof ridge anchor off the surface of the roof.

11 Claims, 4 Drawing Sheets

LADDER RIDGE ANCHOR AND ATTACHMENT AND STABILIZER SYSTEM

CROSS REFERENCE TO RELATED APPLICATIONS

This patent application claims the benefit of priority based on U.S. Provisional Patent Application No. 60/820,649 filed on Jul. 28, 2006, and entitled "Ladder Ridge Attachment and Stabilizer Assembly" which is incorporated herein by reference.

BACKGROUND OF INVENTION

Embodiments of the invention disclosed herein relate to ladder attachment devices, and more particularly to new and improved mechanisms for attaching a ladder to a ladder ridge anchor to secure the ladder over the roof ridge of a building. These embodiments also allow the user to easily adjust the position of the ladder relative to the ladder ridge anchor to facilitate work on and access to the roof or other building areas.

In the performance of their occupation, workers such as painters, carpenters, roofers, firepersons, chimney sweeps, inspectors, handypersons and others are required, at times, to perform their work on inclined roofs. To work on moderate to highly pitched roofs, it is necessary for the person to position some type of support, such as a ladder, or scaffold, on the roof.

When the job is not too extensive, a section of a conventional extension ladder is often employed wherein the ladder is supported in an inclined position on the roof. Securing the ladder to the building to gain access to and work on a roof has traditionally presented problems.

One solution to this problem was illustrated in U.S. Pat. No. 6,913,114 issued to the Blehm. In the Blehm, a Roof Anchor Ladder Attachment Assembly was disclosed that was connected to the rungs of the ladder via clamps. While the attachment mechanism on the Blehm patent was suitable for the Roof Anchor Ladder Attachment Assembly and its disclosed uses, a different attachment mechanism could be beneficial for specific roof configurations.

Often, roofs have peaks and valleys as a result of multiple roof ridges on a structure. Workers on or near these valleys normally have a need to work the entire valley area. The distance between the bottom of the valley and the roof ridge is quite longer than the distance between the top of the valley and the roof ridge. Appropriately, the distance between the roof ridge and the valley changes linearly along the length of the valley.

It is not practical in these situations to utilize a ladder that is supported by the ground. It is also impractical to use a ladder conventionally attached to a roof anchor device because the ladder would have to be continuously adjusted as one traveled along the length of the valley. This would require removal of clamps, adjustment of the ladder, and reinstallation of the clamps. Use of traditional "roof jacks" is prohibitive for various reasons including damage to the roof structure itself.

Another problem associated with ridge ladder anchors is that they lie flat against the roof surface when in position for use. This presents a problem when there are ridge vents installed along the peak of the roof. Typical ridge ladder anchors could easily damage the ridge vents. Often, there are other attic vents or protuberances on the roof that could also be damaged by a ladder or roof ladder anchor. Thus, there is a necessity for a ladder ridge anchor incorporating means to raise the ladder and ladder anchor device off the surface of the roof while still providing safety and stability.

Other related art has attempted to address both the ladder anchor on different occasions. To overcome the ladder anchor problem, it has been proposed to provide ladders with hooks for engaging the ridge of the roof; such an arrangement is shown, for example, in U.S. Pat. Nos. 3,606,226 and 4,678,061.

U.S. Pat. No. 3,606,226 discloses a ridge ladder bracket that is mounted on a roof to provide support for an attached ladder. The ridge bracket disclosed is not adjustable to match the pitch of the roof and the attachment system utilizes a wing nut to fasten the ladder to the ridge bracket. Adjustment of the ladder in relation to the ridge bracket is prohibitive with the means disclosed in this patent. Additionally, there is no lateral stability provided by this ridge bracket and the bracket or attached ladder can easily damage a ridge vent or other protuberance.

A simple ladder roof brace is disclosed in U.S. Pat. No. 4,678,061. This roof brace includes a hook assembly that engages both rungs of a ladder and utilizes a nut and a threaded bolt to affix the ladder to the brace. Adjustment of the ladder in relation to the ridge brace of this patent is prohibitive with the means disclosed. Additionally, there is no lateral stability with use of a single brace. Although this patent discloses use of two braces in one instance, this would not be practical to increase lateral stability and would further add to the time-consuming adjustment problem previously discussed. This brace or an attached ladder can also easily damage a ridge vent or other protuberance.

While these hook assemblies may have been satisfactory for their intended purpose, they have been subject to certain disadvantages, such as being integrally connected to the ladder, thereby rendering the ladder cumbersome when using the ladder on other jobs not requiring the hook assembly; also, many of these configurations are not adjustable for properly engaging ridges of roofs of different pitches. Some of these devices also tend to damage the roofs and thereby render such use prohibitive.

Thus, no related art provides a ladder ridge anchor attachment and stabilizer assembly that can be attached to a ladder and easily adjusted and locked in place. In addition, none also provide access to a roof without causing damage to a roof or ridge vent or other protuberances.

Objects and advantages pertaining to the ladder ridge anchor attachment and stabilizer system disclosed herein will be set forth in part in the description which follows, and in part will become apparent to those skilled in the art upon examination of the following, or may be learned by practice of the invention. The advantages of embodiments of the invention may be realized and attained by means of the instrumentalities and combinations particularly pointed out in the appended claims.

SUMMARY OF INVENTION

An embodiment of the present invention provides a roof ladder ridge anchor attachment and stabilizer system for attaching a ladder thereto and securing a ladder over the roof ridge of the building. It overcomes the deficiencies of the related art by providing a portable device that, with proper use, will not have a destructive effect on the structure of a roof. It also provides a ladder ridge anchor attachment and stabilizer system that can be attached to a ladder and easily adjusted and locked in place.

Another embodiment utilizes extension legs to elevate an attached ladder and portions of the ladder ridge anchor to prevent damage to the roof or ridge vent or other protuberances. All embodiments utilize lateral stabilizer components that help prohibit lateral movement of the ladder in relation to the ladder ridge anchor.

BRIEF DESCRIPTION OF DRAWINGS

The character of an embodiment of the invention, however, may be best understood by reference to its structural form, as illustrated by the accompanying drawings, described below.

DETAILED DESCRIPTION OF THE DRAWINGS

Figure 1:
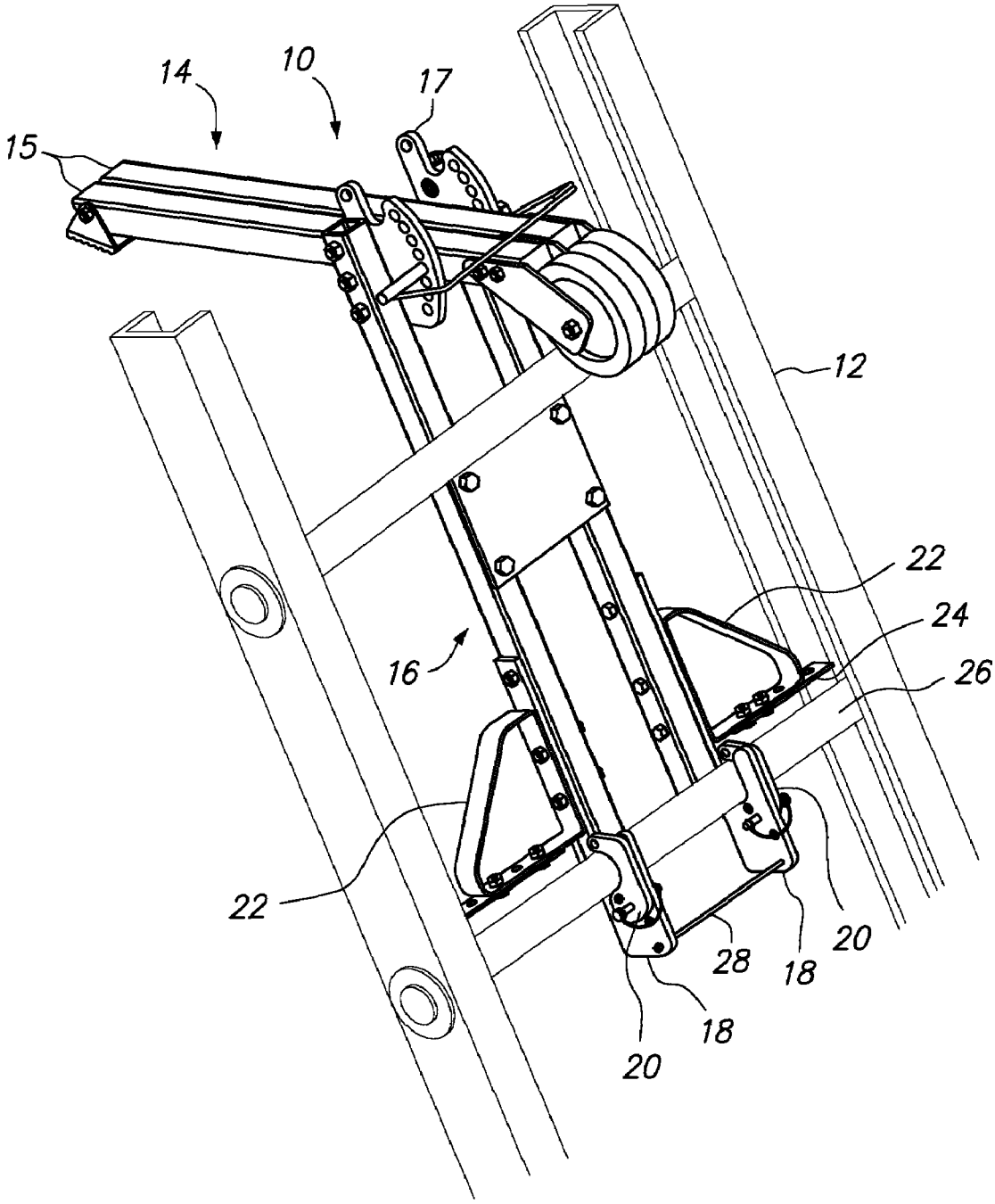
FIG. 1 is a perspective view of an embodiment of the ladder ridge anchor attachment and stabilizer system.

Referring to FIG. 1, which best shows the general features of a preferred embodiment of the invention, the ladder ridge anchor and attachment and stabilizer assembly 10 is shown attached to a ladder 12. The ladder ridge anchor is comprised of an anchor section 14 with at least one anchor or mount leg 15 and a support section 16 pivotally connected to the anchor section utilizing index plates 17. The ladder ridge anchor assembly is connected to the ladder utilizing attachment members 18 (rung hooks) and locked in place with locking members 20 (rung locks). The rung hooks 18 provide rung engagement means and utilize U-shaped openings oriented along the axis of the support section 16. The rung locks 20 provide rung locking means and utilize U-shaped slots that are oriented normal to the axis of the support section when the locks enclose a ladder rung. The rung locks 20 are pivotally attached to the rung hooks 18 and the support section 16.

Centering and stabilizing members are comprised of adjustable lateral guide supports 22 and adjustable lateral guide wings 24 which help center the ladder ridge anchor device and prevent lateral movement of the roof anchor along the rungs 26 of the ladder. They also help prevent movement of the ladder with respect to the ladder ridge roof anchor. A transport and adjustment member 28 (bolt, bar, rod, etc.) is utilized when positioning or transporting the ladder ridge anchor.

Figure 2:
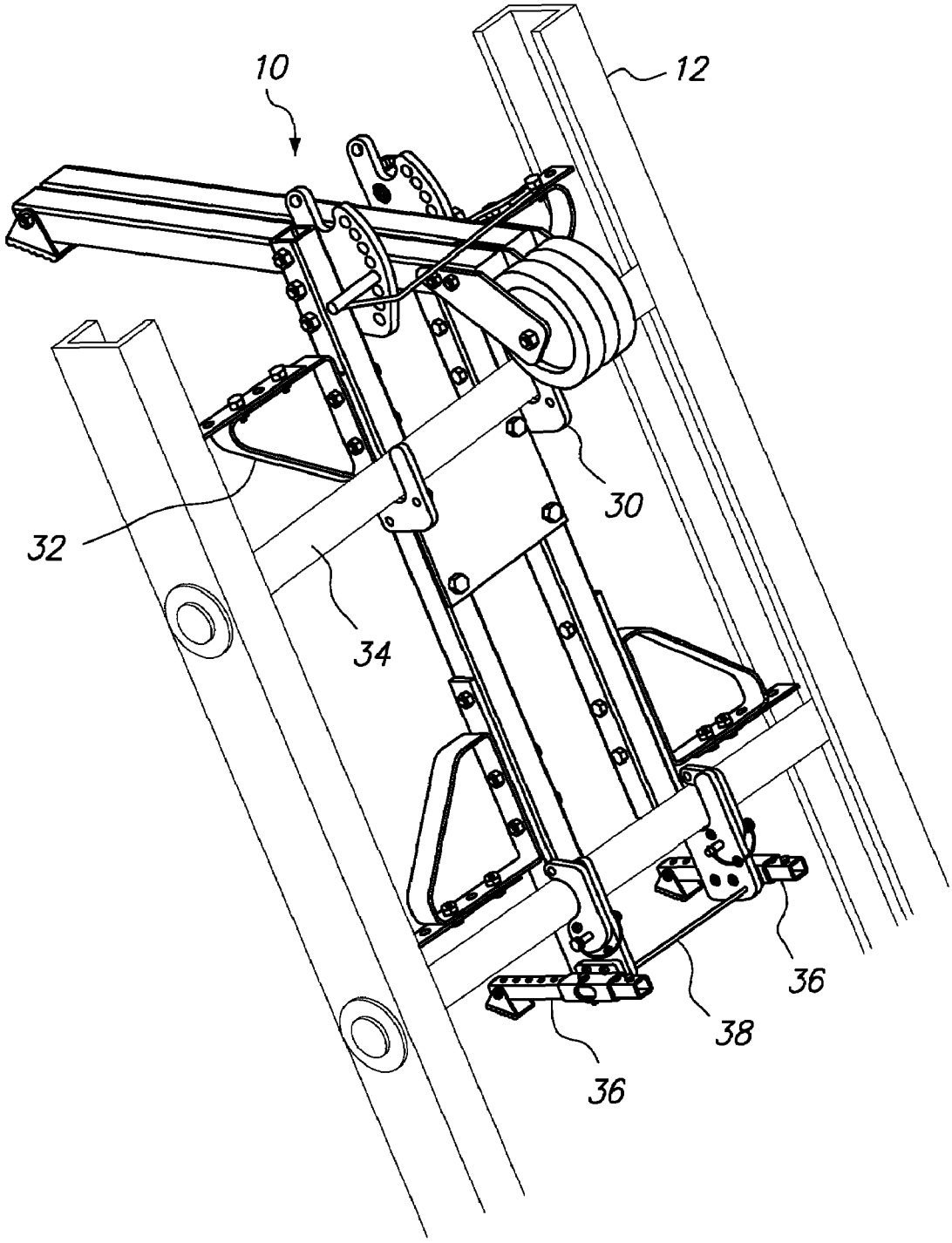
FIG. 2 is a perspective view of an embodiment of the ladder ridge anchor attachment and stabilizer system with extension legs.

FIG. 2 offers another perspective view of the ladder ridge anchor attachment and stabilizer assembly 10 attached to a ladder 12. Upper hooks 30 are attached to the upper rung 34 of the ladder and adjustable lateral guides 32 are utilized also. This embodiment also includes a pair of extension legs 36 that allow the ladder and support section of the ridge ladder assembly to avoid direct contact with the roof, a roof vent or other protuberance. A bolt or bar 38 is shown connecting the two hook and lock mechanisms. This bolt or bar can be used as a transport handle. This allows a user to easily transport the ladder anchor or adjust the elevation of the ladder with respect to the ladder anchor.

Figure 3:
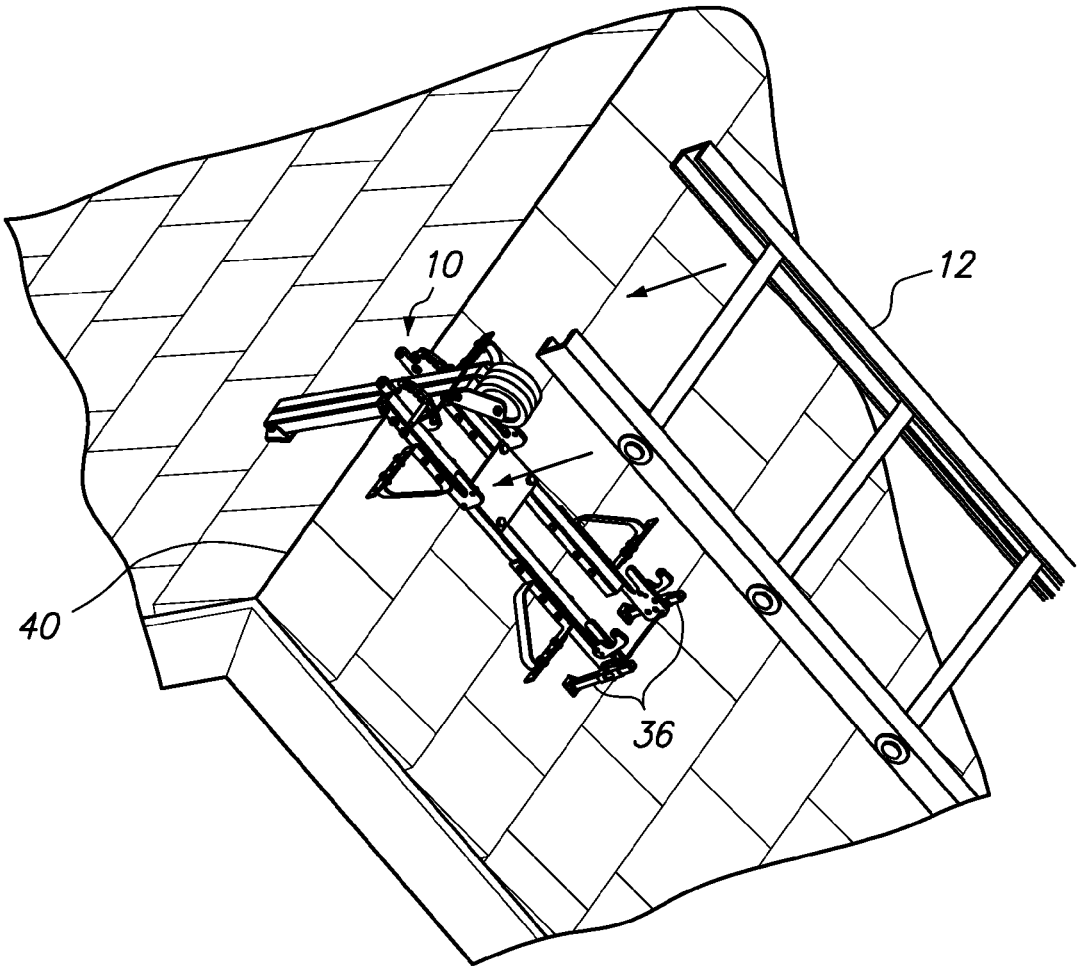
FIG. 3 is a perspective view of the ladder ridge anchor attachment and stabilizer system mounted on a roof and a ladder about to be connected to the ridge anchor system.

FIG. 3 shows a ladder 12 prior to connection to a ladder ridge anchor attachment and stabilizer assembly 10. Extension legs 36 are used in this embodiment of the invention to prevent the support section and ladder from coming in contact with the peak 40 of the roof. Extension legs could be used on roofs where roof ridge vents are installed at the roof peak. Use of the extension legs could help prevent damage to the roof vents from the ladder or ladder ridge anchor.

Figure 4:
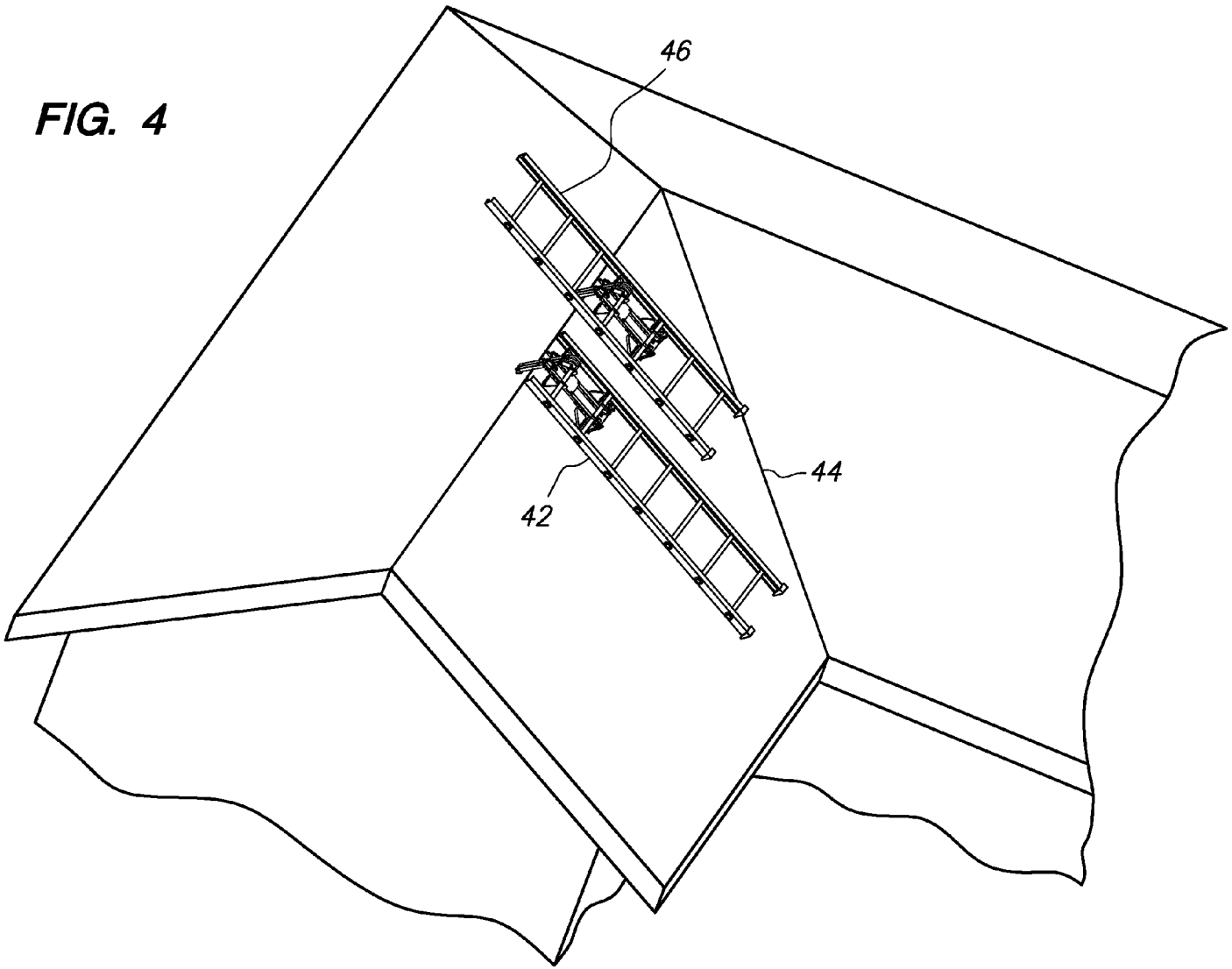
FIG. 4 is a perspective view of a ladder attached to a ridge anchor in different positions relative to a roof ridge and valley.

FIG. 4 shows a ladder in two different positions relative to the ridge anchor device. With the ladder in the first position 42 and attached via the first few rungs as shown in FIG. 4, the bottom of the ladder is near the bottom of the valley 44. With the ladder in the second position 46 and attached via the middle rungs, the bottom of the ladder is near the midway height of the valley. A worker could easily adjust the ladder to provide access around various peaks and valleys that are common in construction.

CONCLUSIONS, OTHER EMBODIMENTS, AND SCOPE OF INVENTION

As described above and shown in the accompanying drawings, the ladder ridge anchor attachment and stabilizer assembly provides a means to access traditionally hard-to-navigate areas of the roof of a building. Embodiments of the present invention can be utilized on roofs that have peaks and valleys that render most ladder assemblies ineffective and/or inefficient. However, use is not limited to roofs that have peaks or valleys.

In one embodiment described and shown in FIG. 1, rung hooks and locks are used on only one rung of an attached ladder. Other embodiments can utilize rungs hooks and rung locks on more than one rung. Yet another embodiment could have rung hooks and locks on one rung and rung hooks (but not locks) on a different rung as shown in FIG. 2. Locks can be utilized to stabilize the assembly before standing upon the ladder. The locks can also be used to secure the assembly and facilitate moving the ladder and assembly up, down, diagonally or laterally on a roof.

Adjustable lateral guides can be used in one location as shown in FIG. 1 or in multiple locations as shown in FIG. 2. Lateral guides can contact an inside edge of a ladder rail or an inside surface to help prevent lateral movement of the ridge anchor with respect to the ladder. The lateral guides illustrated herein are indicative of but one configuration contemplated. Tubular and/or telescoping guides could be utilized as well as guides that are pivotally connected to the roof anchor.

As described herein, extension legs can be utilized in various circumstances. One other application for extensions legs is on metal roofs. Normally the use of "roof jacks" and "toe boards" by roofing installers are used laterally—and can remain, temporarily, when horizontal roofing materials are installed. Metal roofing is installed vertically, so one cannot use laterally installed toe boards and/or roof jacks. A vertical ladder is used by means of a ladder roof anchor holding a ladder that can be moved laterally, as the metal roofing is installed vertically. However, the ladder and ladder anchor can sometimes mar the surface of a metal roof therefore extension legs can be used to lift the ladder and ladder ridge anchor off the roof surface, thus protecting the metal roof.

In addition, there are overlapping seams on some metal roofs that result in uneven roof surfaces. A ladder lying against such a surface could present a problem for workers. In those cases the extension legs could be utilized to circumvent the unevenness of the metal roof due to overlapping panels.

Extension legs shown in FIG. 2 have adjustable telescoping components that are held in a fixed position by positioning pins or bolts. Any extension leg configuration that will satisfy the requirement of raising the ladder and support section of the roof ridge anchor off the roof surface is contemplated. A transport and adjustment member (bar) positioned between the lower hooks and locks serves as a convenient handle for adjusting, positioning or transporting the assembly.

To utilize a ladder ridge anchor attachment stabilizer system secured to a ladder ridge anchor, one would first adjust the centering/stabilizer wing components 24 to match the width of the ladder to be attached thereto. After the centering/stabilizing wing components 24 are secured in the desired position, the ladder ridge anchor device can be placed over the ridge of a roof. A ladder, or ladder section, can then be positioned over the ladder ridge anchor device so that the appropriate rung(s) of the ladder fit into the attachment members (rung hooks 18).

At this point one could use the ladder and the user's weight would hold the ladder in position with the rung hook opening. If desired, the ladder could be secured to the ladder ridge anchor device by utilizing locking members (rung locks 20). The locking members could also be utilized to keep the ladder in position when the ladder ridge anchor device is moved to another location.

Although a particular ladder ridge anchor is illustrated herein, the improvements described can be utilized with any functional ladder ridge anchor. It is preferable that the ladder ridge anchor be adjustable to match the slope of various roofs for practical purposes.

Other embodiments of the invention will be apparent to those skilled in the art from a consideration of the specification or practice of the invention disclosed herein. It should be evident that this disclosure is by way of example and that various changes may be made by adding, modifying, or eliminating details without departing from the fair scope of the teaching contained in this disclosure. The invention is therefore not limited to particular details of this disclosure except to the extent that the following claims are necessarily so limited. Thus it is intended that the specification and examples be considered as illustrative only, with the true scope and spirit of the invention being indicated by the following claims.

What is claimed is:

1. A roof ridge anchor device and support and stabilizer attachment system securable to a ladder, said device and attachment system comprising:

at least one mount leg, two index plates, and two support legs, said at least one mount leg pivotally connected to and situated between said two index plates, said two index plates connected to and situated between said two support legs, a plurality of attachment members connected to said support legs to engage at least one rung of a ladder attached thereto, and a plurality of centering and stabilizer members connected to said attachment members and laterally adjustable with respect to said support legs for approximately centering said roof ring anchor device on said ladder and preventing substantial lateral movement of said roof ridge anchor device with respect to said ladder attached thereto without fastening said centering and stabilizer members to side rails of said ladder, said centering and stabilizer members further comprising a fixed support component and an adjustable lateral guide wing.

2. The roof ridge anchor device and support and stabilizer attachment system of claim 1 wherein each said attachment member further comprises a U-shaped aperture to accept a ladder rung.

3. The roof ridge anchor device and support and stabilizer attachment system of claim 1 further comprising a plurality of locking members pivotally connected to said attachment members to secure at least one rung of said ladder to said roof ridge anchor.

4. The roof ridge anchor device and support and stabilizer attachment system of claim 3 wherein each said locking member further comprises a U-shaped aperture to secure said support and stabilizer attachment system to the rung of a ladder.

5. The roof ridge anchor device and support and stabilizer attachment system of claim 1 wherein said fixed support component and adjustable lateral guide wing further comprise positioning apertures.

6. The roof ridge anchor device and support and stabilizer attachment system of claim 5 further comprising fasteners to connect said adjustable lateral guide wing to said fixed support component.

7. The roof ridge anchor device and support and stabilizer attachment system of claim 1 further comprising extension members to elevate said ladder and roof ridge anchor above a roof surface.

8. The roof ridge anchor device and support and stabilizer attachment system of claim 7 wherein said extension members further comprise positioning apertures for distance settings.

9. The roof ridge anchor device and support and stabilizer attachment system of claim 8 wherein said extension members have adjustable feet to accommodate the slope of a roof.

10. A method of utilizing the roof ridge anchor device and a support and stabilizer attachment system of claim 1, comprising:

laterally adjusting and securing said centering and stabilizer members to match the size of a ladder to be attached thereto without fastening said centering and stabilizer members to side rails of said ladder, and engaging at least one rung of said ladder with said attachment members.

11. The method of claim 10 further comprising securing said roof ridge anchor device and support and stabilizer attachment system to at least one rung of said ladder utilizing at least one locking member.

* * * * *